US005829630A

United States Patent [19]

Fernald

[11] Patent Number: 5,829,630

[45] Date of Patent: Nov. 3, 1998

[54] PROPANE CYLINDER VENDING MACHINE

[75] Inventor: Donald C. Fernald, Rocky River, Ohio

[73] Assignee: Plant Systems Incorporated, Berea, Ohio

[21] Appl. No.: 604,460

[22] Filed: Feb. 21, 1996

[51] Int. Cl.[6] ..... G07F 11/00; A47F 1/04

[52] U.S. Cl. ..... 221/66; 221/312 R; 221/29 B; 221/281; 221/2; 221/289; 193/358; 312/72

[58] Field of Search ..... 221/281, 286, 221/289, 298, 312 R, 312 D, 2, 7, 6, 151, 182, 66; 193/355, 35 R; 194/44, 212; 312/35, 72

[56] References Cited

U.S. PATENT DOCUMENTS

| | | | |
|---|---|---|---|
| 790,776 | 5/1905 | Alvey | 193/35 S |
| 883,297 | 3/1908 | Courtney | 193/35 R |
| 1,969,594 | 8/1934 | Dietrich | 221/151 |
| 2,100,423 | 11/1937 | Zeigler | 221/298 |
| 2,964,154 | 12/1960 | Erickson | 193/35 R |
| 2,990,228 | 6/1961 | Celler | 221/312 R |
| 3,690,430 | 9/1972 | Moreland | 221/298 |
| 4,289,254 | 9/1981 | Spring | 221/298 |
| 4,377,368 | 3/1983 | Koch | 221/298 |
| 4,405,059 | 9/1983 | Kull | 221/298 |
| 4,763,963 | 8/1988 | Lauffer et al. | 221/281 |
| 5,586,665 | 12/1996 | Brousseau | 312/72 |

FOREIGN PATENT DOCUMENTS

| | | | |
|---|---|---|---|
| 2311518 | 12/1976 | France | 221/289 |
| 2423190 | 12/1979 | France | 221/102 |
| 2530590 | 1/1984 | France | 193/355 |
| 2602355 | 2/1988 | France | 221/66 |
| 0173289 | 7/1989 | Japan | 221/289 |
| 9000784 | 1/1990 | WIPO | 221/289 |

*Primary Examiner*—H. Grant Skaggs
*Attorney, Agent, or Firm*—Pearne, Gordon, McCoy & Granger LLP

[57] ABSTRACT

A vending machine for valved cylinders of propane gas is provided which includes a cabinet, a U-shaped roller conveyor and a support rail. The cabinet has return and dispensing openings sized to allow empty cylinders to be returned to the cabinet in an upright orientation and to allow full cylinders to be dispensed from the cabinet in an upright orientation. The return and dispensing openings are vertically offset and horizontally spaced apart. The roller conveyor is within the cabinet and extends from the return opening to the dispensing opening. The roller conveyor is downwardly inclined so that the valved cylinders move along the conveyor by gravity. The support rail extends along both sides of the roller conveyor and maintains the valved cylinders in an upright position while moving from the return opening to the dispensing opening. The vending machine also includes an anti-theft system to prevent unauthorized withdrawals of the valved cylinders from the cabinet. The anti-theft system includes outer and inner doors for the openings and linkages connecting the outer and inner doors so that the inner doors are automatically closed when the outer doors are opened and the inner doors are automatically opened when the outer doors are closed. The vending machine additionally includes an empty-cylinder verification system to ensure that a genuine valved cylinder has been inserted into the return opening before a full cylinder is dispensed from the dispensing opening. The verification system includes a template located adjacent the conveyor near the return opening which has an opening shaped for closely passing genuine valved cylinders and a pair of trip switches which indicate passage of a valved cylinder through the template.

19 Claims, 3 Drawing Sheets

PROPANE CYLINDER VENDING MACHINE

BACKGROUND OF THE INVENTION

1. Field of the Invention

The present invention relates to a vending machine of the type which requires an empty container to be returned before a full container is delivered and, more particularly relates, to such a vending machine for valved cylinders of compressed gas.

2. Description of Related Art

Some products such as, for example, compressed gas are delivered in containers which are more valuable than the product in the container. When such products are sold in vending machines, it is commercially important that a genuine empty container is returned by the purchaser before a full container is delivered to the purchaser. Additionally, it is commercially important that the purchaser cannot remove more than one full container or any empty container from the vending machine.

Standard valved cylinders for propane gas, such as the type typically used for outdoor grilles, pose additional problems. These standard valved cylinders have a cylindrically shaped tank, a base mounted to the bottom of the tank, a valve at the top of the tank, and a guard substantially encircling the valve and providing a pair of lifting handles. The base and the guard have diameters smaller than the diameter of the outer surface of the tank. These standard propane cylinders can be relatively heavy, at least 20 pounds, and difficult for some customers to lift and manipulate.

U.S. Pat. No. 4,778,042, the disclosure of which is expressly incorporated herein in its entirety by reference, discloses a vending machine for cylinders of compressed gas. The machine includes an outer cabinet having a door opening, a storage chain conveyer for horizontally oriented cylinders within the cabinet, and a rotatable transfer cradle between the door opening and the conveyer which prevents access to the conveyor. The transfer cradle is provided with sensors so that a data processor can identify an empty cylinder placed in the transfer cradle through the door opening. Thereafter, the transfer cradle and conveyor are operated to load the empty cylinder into the conveyor and to unload a full cylinder from the conveyor into the transfer cradle for extraction through the door opening. This machine is relatively complex and expensive to produce. Additionally, this machine would require an unreasonable amount of lifting and manipulation of a standard propane cylinder.

U.S. Pat. No. 1,530,288, the disclosure of which is expressly incorporated herein in its entirety by reference, also discloses a vending machine for cylinders of compressed gas. The machine includes an outer cabinet having a opening in the top of the cabinet, an opening at the bottom of the cabinet, and a serpentine passage for horizontally oriented cylinders within the cabinet extending from the top opening to the bottom opening. An empty cylinder is placed in the top opening and a crank arm is rotated which inserts the empty container into the cabinet and moves the container forward into the passage to release a full container out the bottom opening. This machine would also require an unreasonable amount of lifting and manipulation of a standard propane cylinder. Accordingly, there is a need in the art for an improved vending machine for valved cylinders of compressed gas.

SUMMARY OF THE INVENTION

The present invention provides a vending machine for valved cylinders of compressed gas which overcomes at least some of the above-noted problems of the related art. The vending machine includes a cabinet having first and second openings sized to allow the valved cylinders to pass therethrough in an upright orientation. A conveyor is provided within the cabinet which extends from the first opening to the second opening to move the valved cylinders from the first opening to the second opening. The conveyor is adapted for supporting the valved cylinders in an upright orientation while moving the valved cylinders from the first opening to the second opening.

A preferred embodiment of the invention includes an anti-theft system to prevent unauthorized withdrawals of the valved cylinders from the cabinet. The anti-theft system preferably includes an outer door for selectively closing an associated one of the first and second openings respectively, an enclosure, an inner door, and a linkage operatively connecting the inner and outer doors. The enclosure is adjacent the associated one of the first and second openings and forms an enclosed passage from the associated opening to a rear opening of the enclosure. The conveyor extends through the passage of the enclosure. The inner door selectively closes and opens the rear opening of the enclosure. The linkage operatively connects the inner door and the associated outer door so that the inner door is automatically closed when the outer door is opened and the inner door is automatically opened when the outer door is closed.

A preferred embodiment of the vending machine also includes an empty-cylinder verification system to ensure that a genuine valved cylinder has been inserted into the first opening before a full cylinder is dispensed from the second opening. The verification system preferably includes a template located adjacent the conveyor near the first opening. The template has an opening shaped for closely passing genuine valved cylinders therethrough while blocking many items having a differently shaped profile. Preferably at least one trip switch is provided which cooperates with the template to indicate passage of a valved cylinder through the template to further ensure that a genuine valved cylinder is inserted into the vending machine before a full cylinder is dispensed.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figures 1, 2, 3:
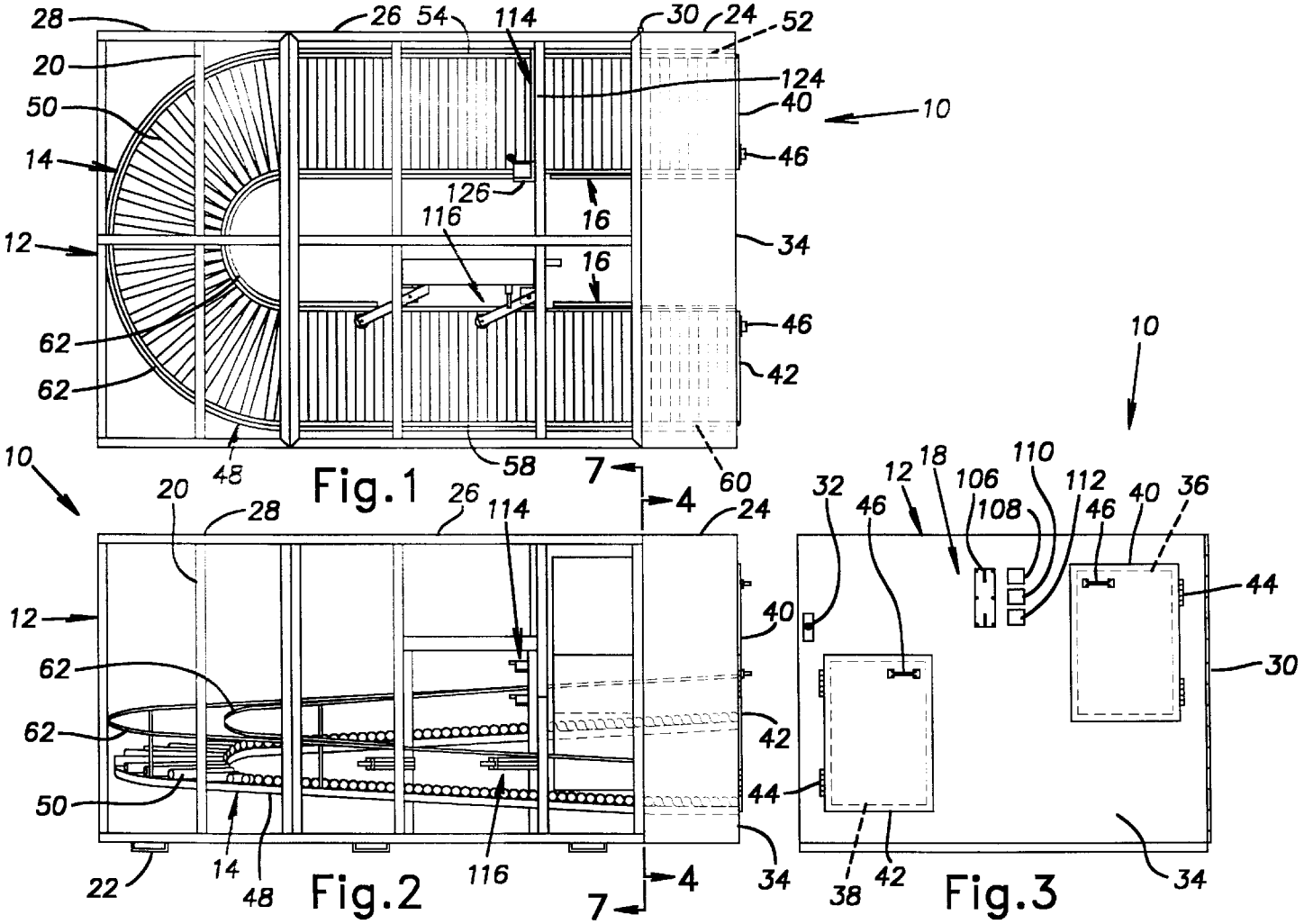
FIG. 1 is a plan view of a vending machine according to the present invention with exterior panels removed for clarity.
FIG. 2. is an elevational side view of the vending machine of FIG. 1 with exterior panels removed for clarity.
FIG. 3 is an elevational end view of the vending machine of FIG. 1.

FIGS. 1–3 illustrate a propane cylinder vending machine 10 according to the present invention which includes a cabinet 12, a conveyor system 14, an anti-theft system 16, and a control system 18. It is noted that other types of gas could alternatively be contained in the valved cylinders. The cabinet 12 includes an internal frame 20 and a plurality of exterior panels, preferably corrugated steel panels, which are attached to the frame 20 to close the cabinet 12 (the outer panels are removed for clarity in the figures). The cabinet 12 also includes transversely extending channels 22 which support the vending machine 10 and enable the vending machine 10 to be moved by conventional material handling equipment.

The cabinet 12 is divided into three portions: a front or loading/unloading portion 24; an intermediate or storage portion 26; and a rear or turn-around portion 28. The front portion 24 is attached to an open forward end of the intermediate section 26 with a hinge 30 at one side so that the front portion 24 can be selectively pivoted between a closed position (shown in FIGS. 1–3) and an open position which provides access to the interior of the cabinet 12. A suitable locking mechanism 32 is provided to lock the front portion 24 in the closed position so that access to the interior of the cabinet 12 is limited to authorized personnel. The rear portion 28 is attached to and closes an open rearward end of the intermediate portion 26. The portions 24, 26, 28 make it possible to use common front and rear portions with intermediate portions of different storage capacity.

The front portion 24 includes a front panel 34 which has a first or return opening 36 and a second or dispensing opening 38 horizontally or laterally spaced apart from the first opening 36, that is, the openings 36, 38 are not horizontally aligned and do not horizontally overlap. The first opening 36 is also vertically offset above the second opening 38, that is, the lower edge of the first opening 36 is higher than the lower edge of the second opening 38. Each opening 36, 38 is sized for transferring a vertically oriented standard propane tank or cylinder therethrough. First and second doors 40, 42 are hingedly mounted on a forward side of the front panel 34 over each opening 36, 38 so that the openings 36, 38 can be selectively opened and closed. Each door 40, 42 is mounted with a hinge 44 at its laterally outward side and is provided with a handle 46 at its laterally inward side so that it can be pulled from a closed position (best shown in FIGS. 1–3) to an open position (one door shown in FIG. 6). Preferably, the outer doors 40, 42 are biased to their closed positions so that they must be held in order to remain in their open positions.

The conveyor system 14 of the illustrated embodiment includes a U-shaped and downwardly inclined roller conveyor 48 having a plurality of rotatably mounted and horizontally disposed rollers 50. The roller conveyor 48 continuously extends from the first opening 36 to the second opening 38 so that a propane cylinder inserted through the first opening 36 and onto the roller conveyor 48 is moved by gravity across the rollers 50 to the second opening 38. The width of the roller conveyor 48 is sized for moving standard propane cylinders while the propane cylinders remain vertically oriented.

The roller conveyor 48 includes a first section 52 which extends straight through the front portion 24 of the cabinet 12 from the lower edge of the first opening 36 to the open rearward end of the front portion 24 of the cabinet 12. A second section 54 of the roller conveyor 24 extends straight through the intermediate portion 26 of the cabinet 12 from the open forward end to the open rearward end of the intermediate portion 26 of the cabinet 12. A third section 56 of the roller conveyor 24 is generally U-shaped and extends through the rear portion 28 of the cabinet 12 with both ends at the forward open end of the rear portion 28 of the cabinet 12. A fourth section 58 of the roller conveyor 48 extends straight through the intermediate portion 26 of the cabinet 12 from the open rearward end to the open forward end the intermediate portion 26 of the cabinet 12. A fifth section 60 of the roller conveyor 48 extends straight through the front portion 24 of the cabinet 12 from the open rearward end of the front portion 24 of the cabinet 12 to the lower edge of the first opening 36. Each section 52–60 of the roller conveyor 48 gradually transitions into the following section of the roller conveyor so that there is a smooth downwardly inclined pathway from the first opening 36 to the second opening 38. Preferably, each of the roller conveyor sections 52–58 are downwardly inclined except for the fifth section 60 which is substantially level.

It is noted that the roller conveyor 48 could alternatively have a different shape such as, for example, straight, J-shaped, S-shaped, spiral-shaped, or serpentine. The different shaped conveyors could be utilized to accommodate the first and second openings 36, 38 being located on different sides of the cabinet 12, to accommodate the first and second openings 36, 38 being horizontally aligned, or to accommodate the storage of a larger amount of propane cylinders. Therefore, the phrase "the first and second openings being horizontally or laterally spaced apart" within the specification and claims is defined to include the first and second openings 36, 38 being on the same side of the cabinet 12 and on different sides of the cabinet 12.

It is also noted that the conveyor system 14 could alternatively include a powered conveyor such as, for example, an endless-belt conveyor or a chain conveyor which does not require gravity to advance the propane cylinders. Accordingly, the first and second openings 36, 38 would not have to be vertically offset when a powered conveyer is utilized.

The conveyor system 14 also includes a support rail 62 on each side of the roller conveyor 48 to maintain the propane cylinders vertically oriented on the roller conveyor 48 as they are moved from the first opening 36 to the second opening 38. The support rail 62 engages a side surface of the tank of the propane cylinders and can be provided with a rubber bumper strip or rollers.

Figures 4, 5, 6:
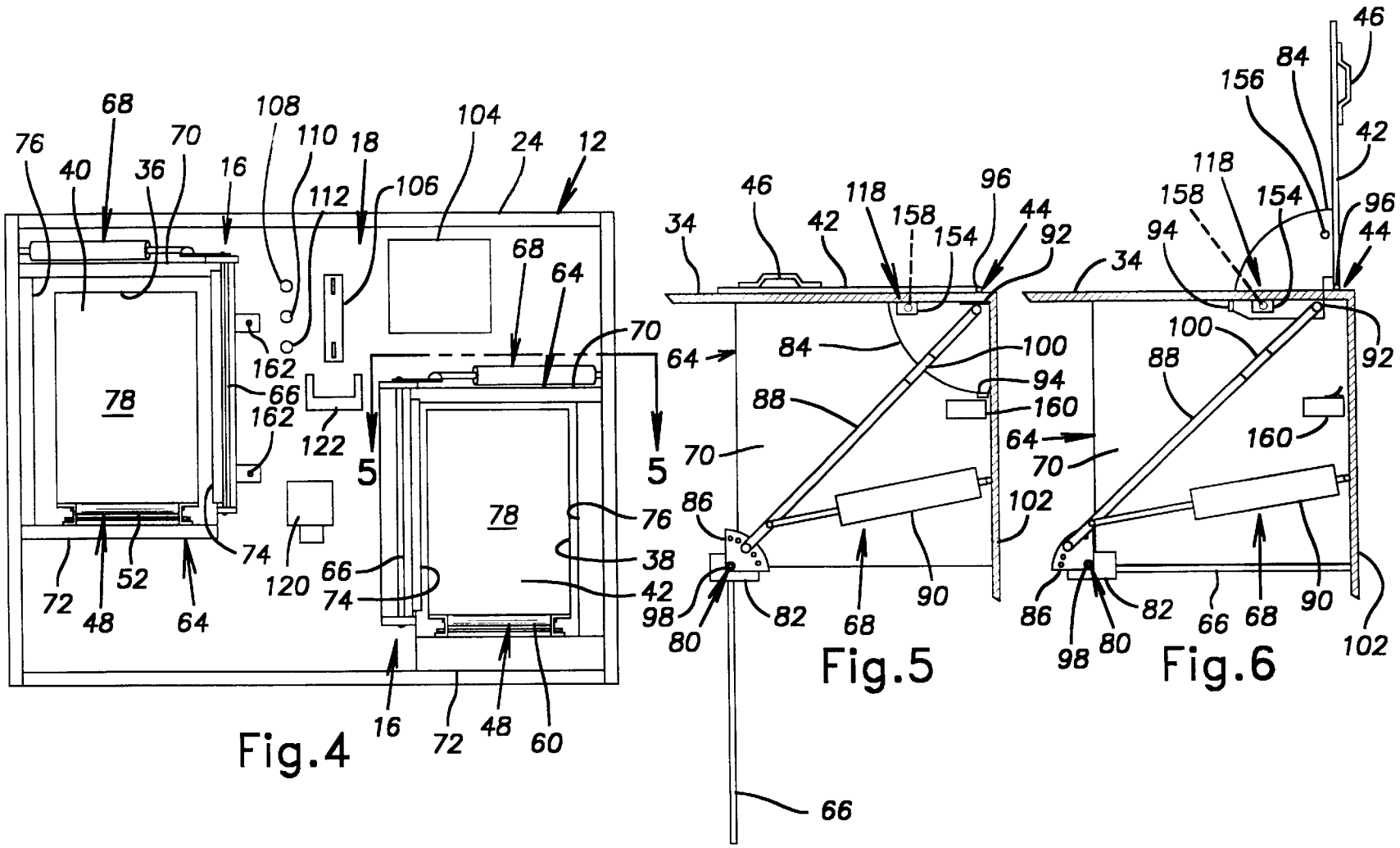
FIG. 4 is an enlarged elevational view taken along line 4—4 of FIG. 2.
FIG. 5 is an enlarged plan view taken along line 5—5 of FIG. 4.
FIG. 6 is a plan view similar to FIG. 5 but with an outer door in an open position and an inner door in a closed position.

As best shown in FIG. 4, an anti-theft system 16 is provided for each of the openings 36, 38 to ensure that no one can reach through the openings 36, 38, when the outer doors 40, 42 are open, to withdraw unauthorized propane cylinders from the vending machine 10. The anti-theft systems 16 are mirror images of one another to account for the oppositely opening outer doors 40, 42. Therefore, only the anti-theft system 16 of the second opening 38 will be described hereafter in detail.

As best shown in FIGS. 4, 5 and 6, each anti-theft system 16 includes an enclosure 64, an inner or anti-theft door 66, and a closing mechanism 68 for the inner door 66 which opens the inner door 66 when the outer door 42 is closed (FIGS. 4 and 5) and closes the inner door 66 when the outer door 42 is open (FIG. 6). The enclosure 64 includes a top panel 70, a bottom panel 72, an inner side panel 74, and an outer side panel 76 which together form an enclosed passage 78 within the front portion 24 of the cabinet 12 adjacent the second opening 42 in the front panel 34. The fifth section 60 of the roller conveyer 48 extends through the passage 78 adjacent the bottom panel 72. The passage 78 is sized to allow a vertically oriented propane cylinder to pass therethrough on the roller conveyer 48. The forward end of the passage 78 is closed by the second outer door 42 when the second outer door 42 is in its closed position (best shown in FIGS. 4 and 5) and is open when the second outer door 42 is in its open position (best shown FIG. 6).

The inner door 66 is pivotally mounted at its laterally inward side to the rear open end of the enclosure 64 with an axle member 80. The axle member 80 is supported at its top and bottom ends by a pair of spaced apart support blocks 82 fixed to the enclosure 64. The inner door 66 is pivotable between an open position (best shown FIGS. 4 and 5) wherein the rearward end of the passage 78 is open and a closed position (best shown in FIG. 6) wherein the rearward end of the passage 78 is closed.

The closing mechanism 68 includes first and second connecting members 84, 86, a linkage 88, and an air damping member 90. The first connecting member 84 is fixed to the second outer door 42. The first connecting member 84 is a generally pie-shaped flat sheet, that is, having two straight and perpendicular edges forming a point and an outwardly arcuate edge opposite the point. One straight edge is fixed to the second outer door 42 near the top edge of the second outer door 42 and adjacent the laterally outer side of the second outer door 42 such that the other straight edge is adjacent the side of the cabinet 12 when the second outer door 42 is in its closed position (best shown in FIG. 5). Fixed to the second outer door 42 in this manner, the first connecting member 84 extends over the top panel 70 of the enclosure 64. The first connecting member 84 has a notch 92 to provide clearance for the front panel 34 when the second outer door 42 in its closed position. The first connecting member 84 also has an upwardly extending projection 94 which engages the rearward side of the front panel 34 to limit the opening of the second outer door 42 to about 90 degrees.

The second connecting member 86 is fixed to the top end of the axle member 80 of the inner door 66. The second connecting member 86 is also a generally pie-shaped flat sheet but smaller than the first connecting member 84. The second connecting member 6 is fixed to the top of the axle member 80 near the point such that the arcuate edge is facing the arcuate edge of the first connecting member 84 when the second outer door 42 is closed and the inner door 66 is open (best shown in FIG. 5). Fixed to the inner door 66 in this manner, the second connecting member 86 extends over the top panel 70 of the enclosure 64.

The linkage 88 is a generally elongate and rigid rod. A first end of the linkage 88 is pivotally attached to the first connecting member 84 near the point of the first connecting member 84 and offset from the rotational axis 96 of the second outer door 42. A second end of the linkage 88 is pivotally attached to the second connecting member 86 near the arcuate edge and offset from the rotational axis 98 of the inner door 66. The linkage 88 extends over the top panel 70 of the enclosure 64 and over the connecting members 84, 86. It is noted that the linkage 88 is provided with an upwardly extending bend 100 for the passage of the projection 94 of the first connecting member 84 thereunder. With the linkage 88 attached in this manner, the inner door 66 is closed when the second outer door 42 is opened and the inner door 66 is opened when the second outer door 42 is closed. The air damping member 90 extends between the second end of the linkage 88 and a side wall 102 of the cabinet 12 to ensure a smooth opening and closing of the outer and inner doors 42, 66.

As best shown in FIGS. 1–5, the control system 18 includes a data processing unit or programmable controller 104, a coin or token monitoring device 106, three indicator lights 108, 110, 112, an empty-cylinder verification system 114, a full-cylinder release system 116, and locking mechanisms 118 for the outer doors 40, 42. As best seen in FIG. 4, the controller 104 is mounted on the rearward side of the front panel 34 along with a cooperating power supply 120. The controller 104 is programmed to receive and send signals with each of the components of the control system 18 to control the operation of the vending machine 10 as will be described in more detail hereafter. For example, the controller 104 is programmed to maintain a count of the number of full propane cylinders remaining within the vending machine 10.

As best shown in FIGS. 3 and 4, the token monitoring device 106 is mounted within an opening in the front panel 34 and has inlet and returns slots for coins or tokens. Attached to the rearward side of the front panel 34 and below the token monitoring device 106 is a storage bin 122 for receiving tokens input into the token monitoring device 106. Also mounted within openings in the front panel 34 are the three indicator lights 108, 110, 112. The first indicator light 108 instructs a customer to open the first outer door 40, to insert an empty propane cylinder, and to close the first outer door 40. The second indicator light 110 instructs the customer to open the second outer door 42, to withdraw a full propane cylinder, and to close the second outer door 42. The third indicator light 112 instructs a potential customer that no full propane cylinders remain within the vending machine 10.

Figure 7:
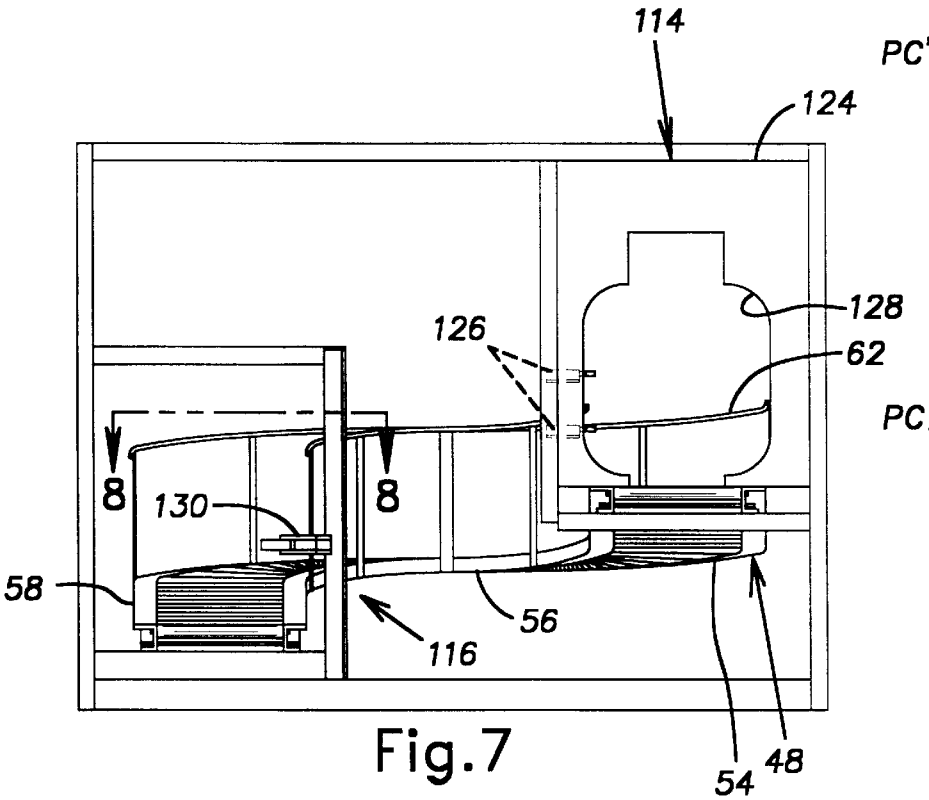
FIG. 7 is an enlarged elevational view taken along line 7—7 of FIG. 2; and FIG.. 8 is an enlarged plan view taken along line 8—8 of FIG. 7.

The empty-cylinder verification system 114 is provided to ensure that an empty propane cylinder is inserted into the vending machine 10 before a full propane cylinder is dispensed from the vending machine 10. As best shown in FIGS. 1 and 7, the empty-cylinder verification system 114 includes a template 124 and a pair of trip switches 126. The template 124 is a flat sheet having an opening 128 shaped for allowing a standard propane cylinder to closely pass therethrough while preventing many other objects having a differently shaped profile from passing therethrough. The template 124 is located above the second section 54 of the roller conveyor 48 and spaced from the inner door 66 a distance adequate for providing clearance for the inner door 66 to open and close. The trip switches 126 are vertically spaced apart and located at a side of the opening 128 in the template 124 so that a side surface of the tank of a propane cylinder passing through the opening 128 will activate the trip switches 126. More than one trip switch 126 is utilized to further ensure that it is actually a standard propane cylinder which is passing through the template opening 128.

Figure 8:
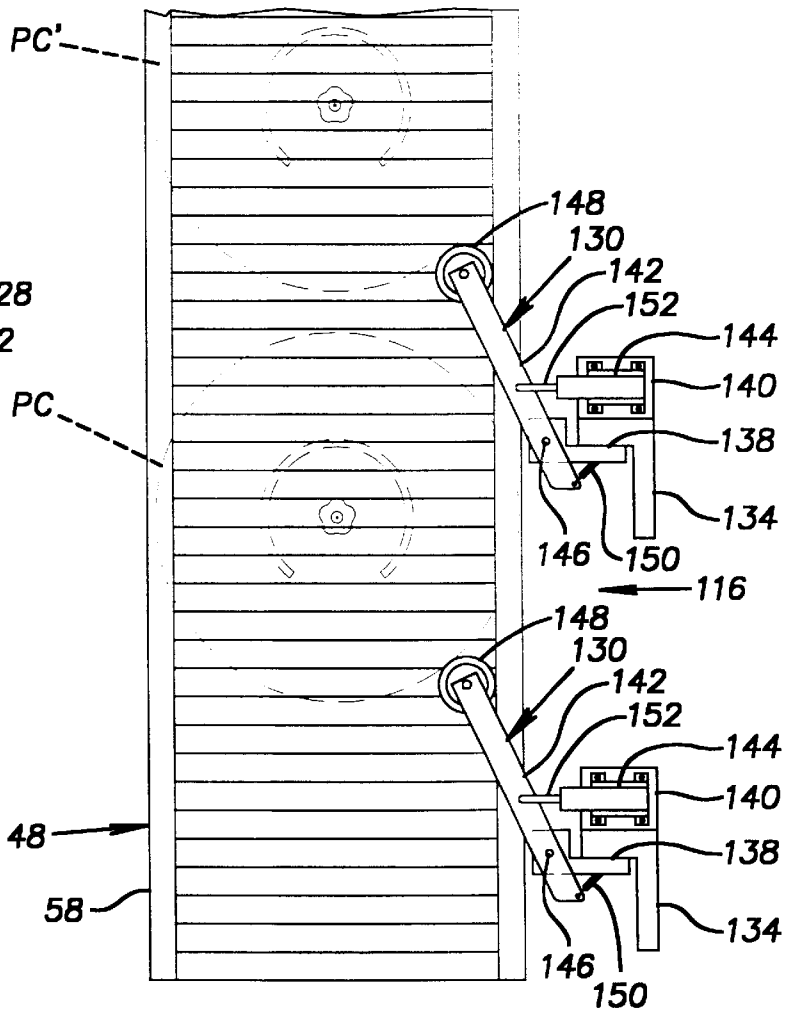

The full-cylinder release system 116 is provided to ensure that only one full propane cylinder is released after it has been verified that an empty propane cylinder has been inserted into the vending machine 10. As best shown in FIGS. 7 and 8, the full-cylinder release stem 116 includes a pair of retractable arm mechanisms 130, 132. The first retractable arm mechanism 130 is attached to a vertical beam 134 adjacent the fourth section 58 of the roller conveyor 48 to block movement of the first propane cylinder PC to be dispensed from the vending machine 10 in a position which provides adequate clearance for the inner door 66 to open and close. The second retractable arm mechanism 132 is attached to another vertical beam 136 adjacent the fourth section 58 of the roller conveyor 48 and upstream from the first retractable arm mechanism 130 to block movement of the second propane cylinder PC' in line to be dispensed from the vending machine 10. The retractable arm mechanisms 130, 132 are structurally identical except for there location. Therefore, only the first retractable arm mechanism 130 will be described hereafter in detail.

As best shown in FIG. 8, each retractable arm mechanism 130, 132 includes first and second support brackets 138, 140, an arm member 142, and a linear actuator or servo 144. The first support bracket 138 is attached to the vertical beam 134 at a location which positions the arm member 142 to engage the side surface of the propane cylinder PC. A first end of the arm member 142 is pivotally attached to the first support bracket 138 so that the arm member 142 is rotatable about a vertical axis of rotation 146 between a blocking position (best shown in FIG. 8) wherein the arm member 142 extends over the roller conveyor 48 to block passage of the propane cylinder PC and a dispensing position (not shown) wherein the arm member 142 extends along the side of the roller conveyor 48 to allow passage of the propane cylinder PC. A roller 148 is rotatably attached to the second end of the arm member 142 to ease movement of the arm member 142 between positions. Means 150 are provided for biasing the arm member 142 to the blocking position. The biasing means 150 of the illustrated embodiment is a tension spring extending between the first end of the arm member 142 and the first support bracket 138. The second support bracket 140 is attached to the vertical beam 134 at a location which positions the servo 144 so that a retractable pin 152 of the servo 144 engages the arm member 142. The servo 144 is positioned for retracting the pin 152 substantially perpendicular to the roller conveyer 48. The pin 152 is pivotally attached to the arm member 142 at a location spaced from the rotational axis 146 of the arm member 142. When the pin 152 is retracted by the servo 144, the biasing means 150 is overcome and the arm member 142 is rotated from the blocking position to the dispensing position.

The locking mechanisms 118 for the outer doors 40, 42 ensure that the outer doors 40, 42 can not be opened except at appropriate times. The locking mechanisms 118 for the first and second outer doors 40, 42 are structurally identical, therefore, only the locking mechanism 118 for the second outer door 42 will be described hereafter in detail. As best shown in FIGS. 5 and 6, the locking mechanism 118 in includes a linear actuator or servo 154 mounted on the rearward side of the front panel 34 above the enclosure 64 and above the first connecting member 84 attached to the second outer door 42. An opening 156 is provided in the first connecting member 84 at a location adjacent the second outer door 42 for receiving a pin 158 of the servo 154 when the second outer door 42 is in the closed position (best shown in FIG. 5) to lock the second outer door 42 in the closed position. The pin 158 is typically fully extended through the opening 156 to lock the second outer door 42 in its closed position. When the servo 154 is activated however, the pin 158 is retracted out of the opening 156 so that the second outer door 42 can be pulled to the open position (best shown in FIG. 6).

As best shown in FIGS. 5 and 6, at least the second outer door 42 is provided with a trip switch 160 to indicate that the second outer door 42 is in its closed position. The trip switch 160 of the illustrated embodiment is mounted on an upper side of the top panel 70 of the enclosure 64 and is engaged by the projection 94 of the first connecting member 84 when the second outer 42 door is in its closed position (best shown in FIG. 5).

To obtain a full propane cylinder from the vending machine 10, a customer inserts an appropriate amount of coins or tokens into the token monitoring device 106. When the monitoring device 106 receives the amount of coins or tokens appropriate for the transaction, the monitoring device 106 signals the controller 104. The controller 104 energizes the servo 154 of the first outer door locking mechanism 118 to unlock the first outer door 40. The controller 104 then energizes the first indicator light 108 to instruct the customer to open the first outer door 40, to insert an empty propane cylinder and to close the first outer door 40. Upon seeing the first indicator light 108, the customer opens the first outer door 40 which automatically closes the inner door 66 so that the customer cannot reach into the interior of the cabinet 12. The customer inserts an empty propane cylinder onto the first section 52 of the roller conveyor 48. Movement of the empty propane cylinder down the roller conveyor 48 and out of the enclosure 64 is blocked by the closed inner door 66. The customer closes the first outer door 40 which automatically opens the inner door 66 and allows the empty propane cylinder to move by gravity out of the enclosure 64 and down the roller conveyor 48.

The empty propane cylinder passes through the template 124 and activates the two trip switches 126. The trip switches 126 send a signal to the controller 104 that a genuine propane cylinder has passed through the template 124. The empty propane cylinder continues to move down the roller conveyor 48 until it engages another propane cylinder blocking its path. Upon receiving the signal from the trip switches 126, the controller 104 energizes the servo 144 of the first retractable arm mechanism 130 to retract the arm member 142 to the dispensing position. The first full propane cylinder PC is released and moves down the roller conveyor 48 to the fifth section 60 of the roller conveyor 48 and within the enclosure 64. Upon receiving the signal from the trip switches 126, the controller 104 also de-energizes the servo 154 of the first outer door locking mechanism 118 to lock the first outer door 40 in its closed position.

After an adequate time delay to allow the full propane cylinder PC to move into the dispensing position in the enclosure 64, the controller 104 energizes the servo 154 of the second outer door locking mechanism 118 to unlock the second outer door 42. The controller 104 then energizes the second indicator light 110 to instruct the customer to open the second outer door 42, to remove the full propane cylinder, and to close the second outer door 42. Upon seeing the second indicator light 110, the customer opens the second outer door 42 which automatically closes the inner door 66 so that the customer cannot reach into the interior of the cabinet 12. The full propane cylinder does not move by gravity down the roller conveyor 48 and out of the enclosure 64 because the fifth section 60 of the roller conveyor is substantially level. The customer removes the full propane cylinder from the fifth section 60 of the roller conveyor 48. The customer closes the second outer door 42 which automatically opens the inner door 66.

When the second outer door 42 is closed, the projection 96 activates the trip switch 160 which signals the controller 104 that the second outer door 42 is closed. Upon receiving the signal from the trip switch 160, the controller 104 de-energizes the servo 154 of the second outer door locking mechanism 118 to lock the second outer door 42 in its closed position. Upon receiving the signal from the trip switch 160, the controller 104 also de-energizes the servo 144 of the first retractable arm mechanism 130 so that the biasing means 150 returns the arm member 142 to its blocking position. Thereafter, the controller 104 energizes the servo 144 of the second retractable arm mechanism 130 to retract the arm member 142 to its dispensing position so that the propane cylinders all move down the roller conveyor 48 and are indexed one position. Accordingly, the second full propane cylinder PC' becomes the new first full propane cylinder PC and is blocked by the first retractable arm mechanism 130. After an adequate time delay, the controller 104 de-energizes the servo 144 of the second retractable arm mechanism 130 so that the biasing means 150 returns the arm member 142 to its blocking position to block the new second full propane cylinder PC'.

The controller 104 determines if there are any remaining full propane cylinders in the vending machine 10. If there is at least one remaining full propane cylinder, the vending machine 10 is ready for another transaction. If there are no remaining full propane cylinders, the controller 104 energizes the third indicator light 112 which instructs potential customers that there are no remaining full propane cylinders in the vending machine.

To service or reload the vending machine 10, the locking mechanism 32 is unlocked and the front portion 24 of the cabinet is pivoted open. The servos 144 of the first and second retractable arm mechanisms 130, 132 are manually energized by depressing a pair of push buttons 162 (FIG. 4) mounted on the front portion 24 of the cabinet 12. By sequentially energizing the servos 144, all of the propane cylinders can be released and removed from the roller conveyor 48. Full propane cylinders are then loaded onto the second section 54 of the roller conveyor 48 so that they advance by gravity into position for dispensing. Preferably, the conveyor is sized for holding about 20 to about 25 propane cylinders. The servo 144 of the second retractable arm mechanism 132 is then manually energized and de-energized so that the first full propane cylinder PC moves down and is blocked by the first retractable arm mechanism 130 and the second full propane cylinder PC' moves down and is blocked by the second retractable arm mechanism 132. Finally, the controller 104 is reset with the quantity of full propane cylinders in the vending machine 10, the front portion 24 of the cabinet 12 is pivoted closed, and the locking mechanism 32 is locked.

Although particular embodiments of the invention have been described in detail, it will be understood that the invention is not limited correspondingly in scope, but includes all changes and modifications coming within the spirit and terms of the claims appended hereto.

What is claimed is:

1. A vending machine for valved cylinders of compressed gas, said vending machine comprising:

a cabinet having first and second openings sized to allow the valved cylinders to pass therethrough in an upright orientation, first and second passages associated with said first and second openings, first and second outer doors selectively closing and opening said first and second openings respectively, first and second inner doors respectively closing and opening said first and second passages, and linkages operatively connecting said first and second inner doors to said first and second outer doors respectively such that said first and second inner doors automatically close when an associated one of said first and second outer doors is opened and said first and second inner doors automatically open when the associated one of said first and second outer doors is closed; and a roller conveyor within said cabinet and continuously extending from said first opening to said second opening and through said first and second passages to move the valved cylinders from said first opening to said second opening, said roller conveyor being continuously inclined in a downward direction so that the valved cylinders move from said first opening to said second opening solely by a force of gravity, said conveyor being adapted for supporting the valved cylinders in an upright orientation while moving the valved cylinders from said first opening to said second opening.

2. The vending machine according to claim 1, wherein said first and second openings are vertically offset.

3. The vending machine according to claim 1, wherein said conveyor is generally U-shaped.

4. The vending machine according to claim 1, wherein said first and second openings are horizontally spaced apart.

5. The vending machine according to claim 1, further comprising a template having an opening shaped for closely passing genuine valved cylinders therethrough, said template being located adjacent said conveyor generally near said first opening.

6. The vending machine according to claim 5, further comprising at least one trip switch cooperating with said template for indicating passage of a valved cylinder through said template.

7. The vending machine according to claim 1, further comprising a pair of retractable arm mechanisms located adjacent said conveyor generally near said outlet opening and spaced apart a distance adequate for blocking adjacent valved cylinders located on said conveyor, each of said retractable arm mechanisms having an arm member movable between a blocking position wherein said arm member extends over said conveyor to block passage of the valved cylinders and a dispensing position wherein said arm member extends away from said conveyor to allow passage of the valved cylinders.

8. A vending machine for valved cylinders of compressed gas, said vending machine comprising a cabinet having first and second openings sized to allow the valved cylinders to pass therethrough in an upright orientation, a conveyor within said cabinet and extending from said first opening to said second opening to move the valved cylinders from said first opening to said second opening, said conveyor being adapted for supporting the valved cylinders in an upright orientation while moving the valved cylinders from said first opening to said second opening, first and second outer doors for selectively closing and opening said first and second openings respectively, an enclosure within said cabinet and associated with one of said first and second openings, said enclosure forming a passage from said associated one of said first and second openings to a rear opening of said enclosure with said conveyor extending through said passage of said enclosure, an inner door for selectively closing and opening said rear opening of said enclosure, and a linkage operatively connecting said inner door to an associated one of said first and second outer doors such that said inner door is automatically closed when said associated outer door is opened and said inner door is automatically opened when said associated outer door is closed.

9. A vending machine for valved cylinders of compressed gas, said vending machine comprising:

a cabinet having an inlet and an outlet sized to allow the valved cylinders to pass therethrough in an upright orientation, inlet and outlet passages associated with said inlet and outlet respectively, inlet and outlet doors selectively closing and opening said inlet and outlet respectively, inlet and outlet passage doors respectively closing and opening said inlet and outlet passages, and linkages operatively connecting said inlet and outlet passage doors to said inlet and outlet doors respectively such that said inlet and outlet passage doors automatically close when an associated one of said inlet and outlet doors is opened and said inlet and outlet passage doors automatically open when the associated one of said inlet and outlet doors is closed;

a downwardly inclined conveyor within said cabinet and extending from said inlet to said outlet and through said inlet and outlet passages to move the valved cylinders from said inlet to said outlet by gravity, said conveyor being adapted for supporting the valved cylinders in an upright orientation while moving the valved cylinders from said inlet to said outlet; and a pair of retractable arm mechanisms located adjacent said conveyor generally near said outlet opening and spaced apart a distance adequate for blocking adjacent valved cylinders on said conveyor, each of said retractable arm mechanisms having an arm member movable between a blocking position wherein said arm member extends over said conveyor to block passage of the valved cylinders and a dispensing position wherein said arm member extends away from said conveyor to allow passage of the valved cylinders.

10. The vending machine according to claim 9, wherein said conveyor is continuously inclined in a downward direction to move the valved cylinders from said first opening to said second opening solely by a force of gravity.

11. The vending machine according to claim 10, wherein said conveyor is a roller conveyor for moving the valved cylinders by gravity.

12. The vending machine according to claim 9, wherein said inlet and said outlet are separate and vertically offset first and second openings.

13. The vending machine according to claim 9, wherein said conveyor is a roller conveyor.

14. The vending machine according to claim 9, wherein said conveyor is generally U-shaped.

15. The vending machine according to claim 9, wherein said inlet and said outlet are separate and horizontally spaced apart first and second openings.

16. The vending machine according to claim 9, further comprising a template having an opening shaped for closely passing genuine valved cylinders therethrough, said template being located adjacent said conveyor generally near said inlet.

17. The vending machine according to claim 16, further comprising at least one trip switch cooperating with said template for indicating passage of a valved cylinder through said template.

18. A vending machine for valved cylinders of compressed gas, said vending machine comprising:

a cabinet having first and second openings sized to allow the valved cylinders to pass therethrough in an upright orientation, said first and second openings being vertically offset and horizontally spaced apart, first and second passages associated with said first and second openings, first and second outer doors selectively closing and opening said first and second openings respectively, first and second inner doors respectively closing and opening said first and second passages, and linkages operatively connecting said first and second inner doors to said first and second outer doors respectively such that said first and second inner doors automatically close when an associated one of said first and second outer doors is opened and said first and second inner doors automatically open when the associated one of said first and second outer doors is closed; and a roller conveyor within said cabinet and continuously extending from said first opening to said second opening and through said first and second passages, said roller conveyor being continuously inclined in a downward direction for moving the valved cylinders from said first opening to said second opening solely by a force of gravity, said roller conveyor being U-shaped between said first opening and said second opening; and a support rail along said roller conveyor for maintaining the valved cylinders in an upright position while moving from said first opening to said second opening on said roller conveyor.

19. The vending machine according to claim 18, further comprising a pair of retractable arm mechanisms located adjacent said conveyor generally near said outlet opening and spaced apart a distance adequate for blocking adjacent valved cylinders located on said conveyor, each of said retractable arm mechanisms having an arm member movable between a blocking position wherein said arm member extends over said conveyor to block passage of the valved cylinders and a dispensing position wherein said arm member extends away from said conveyor to allow passage of the valved cylinders.

* * * * *

UNITED STATES PATENT AND TRADEMARK OFFICE

CERTIFICATE OF CORRECTION

PATENT NO. : 5,829,630

DATED : November 3, 1998

INVENTOR(S) : Fernald

It is certified that error appears in the above-identified patent and that said Letters Patent is hereby corrected as shown below:

On the title page, References Cited, U.S. PATENT DOCUMENTS, insert

| | | |
|---|---|---|
| --1,530,288 | 3/1925 | Balkena |
| 1,861,071 | 5/1932 | Vorhies |
| 4,778,042 | 10/1988 | Warren et al.--. |

Column 2, Line 61, delete "FIG.." and insert --FIG.--.

Signed and Sealed this

Fourth Day of May, 1999

*Attest:*

*Attesting Officer*

Q. TODD DICKINSON

*Acting Commissioner of Patents and Trademarks*